US010794641B2

(12) United States Patent
Sharma

(10) Patent No.: US 10,794,641 B2
(45) Date of Patent: Oct. 6, 2020

(54) HEAT EXCHANGER

(71) Applicant: DENSO International America, Inc., Southfield, MI (US)

(72) Inventor: Rajeev Sharma, Troy, MI (US)

(73) Assignee: DENSO International America, Inc., Southfield, MI (US)

( * ) Notice: Subject to any disclaimer, the term of this patent is extended or adjusted under 35 U.S.C. 154(b) by 123 days.

(21) Appl. No.: 15/899,175

(22) Filed: Feb. 19, 2018

(65) Prior Publication Data

US 2019/0257596 A1 Aug. 22, 2019

(51) Int. Cl.

| | |
|---|---|
| ***F28F 9/18*** | (2006.01) |
| ***F28D 21/00*** | (2006.01) |
| ***F28F 21/08*** | (2006.01) |
| ***F28F 9/02*** | (2006.01) |

(52) U.S. Cl.

CPC ..... *F28F 9/182* (2013.01); *F28F 9/0224* (2013.01); *F28F 21/084* (2013.01); *F28D 2021/0084* (2013.01); *F28F 2225/08* (2013.01)

(58) Field of Classification Search

CPC ..... F28F 9/0224; F28F 9/182; F28F 2280/06
See application file for complete search history.

(56) References Cited

U.S. PATENT DOCUMENTS

| | | | | |
|---|---|---|---|---|
| 5,284,289 | A | 2/1994 | Killian | |
| 5,855,354 | A | 1/1999 | Fisher et al. | |
| 2011/0088884 | A1* | 4/2011 | Amaya | F02B 29/0462 165/173 |
| 2018/0172355 | A1* | 6/2018 | Takase | F28F 9/02 |

FOREIGN PATENT DOCUMENTS

| | | | | |
|---|---|---|---|---|
| JP | 07234088 | A * | 9/1995 | F28F 9/002 |
| JP | 11281286 | A * | 10/1999 | F28F 9/0251 |
| JP | 2005061708 | A * | 3/2005 | F28F 9/002 |

OTHER PUBLICATIONS

Machine Translation of JP2005-061708A (Year: 2005).*
Machine Translation of JP11-281286A (Year: 1999).*
Plug Welds and MIG Spot Welding, migwelding the DIY guide, screenshot captured Dec. 5, 2016 (Year: 2016).*
Machine Translation of JP-07234088-A (Year: 1995).*

* cited by examiner

*Primary Examiner* — Christopher M Koehler
*Assistant Examiner* — Kyle A Cook
(74) *Attorney, Agent, or Firm* — Harness, Dickey & Pierce, P.L.C.

(57) ABSTRACT

A heat exchanger having a core. A header is on a side of the core, and a tank is brazed to the header. A connector is brazed to an outer surface of the tank. A welding aperture is defined by the tank beneath the connector. A weld at the welding aperture secures the connector to the tank prior to brazing of the connector and the tank together.

12 Claims, 2 Drawing Sheets

HEAT EXCHANGER

FIELD

The present disclosure relates to a heat exchanger, and particularly to connections between a heat exchanger tank and sub-components attached thereto, such as connectors.

BACKGROUND

This section provides background information related to the present disclosure, which is not necessarily prior art.

Heat exchangers, such as condensers, typically include a core with tanks and headers at opposite ends thereof. The tanks and headers are brazed together to create a seal therebetween. Various connectors are attached to the tanks, also by brazing. Prior to brazing, the connectors are held in place against the tanks with spot welds. Heat generated during spot welding may undesirably deform and damage the surfaces of the tank and header that interface with one another, which may make it difficult to braze the tank and header together in a manner that will create a seal therebetween. This occurs because the spot welding currently takes place at outer edges of the connectors, which is too close to the interface between the tank and the header (see prior art FIG. 5 and the description herein). An improved connection between the tanks and the connectors prior to brazing, which does not damage the header/tank interface, would therefore be desirable. The present teachings address these needs in the art, and numerous others as described herein and as one skilled in the art will appreciate.

SUMMARY

This section provides a general summary of the disclosure, and is not a comprehensive disclosure of its full scope or all of its features.

The present disclosure includes a heat exchanger having a core. A header is on a side of the core, and a tank is brazed to the header. A connector is brazed to an outer surface of the tank. A welding aperture is defined by the tank beneath the connector. A weld at the welding aperture secures the connector to the tank prior to brazing of the connector and the tank together.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of select embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
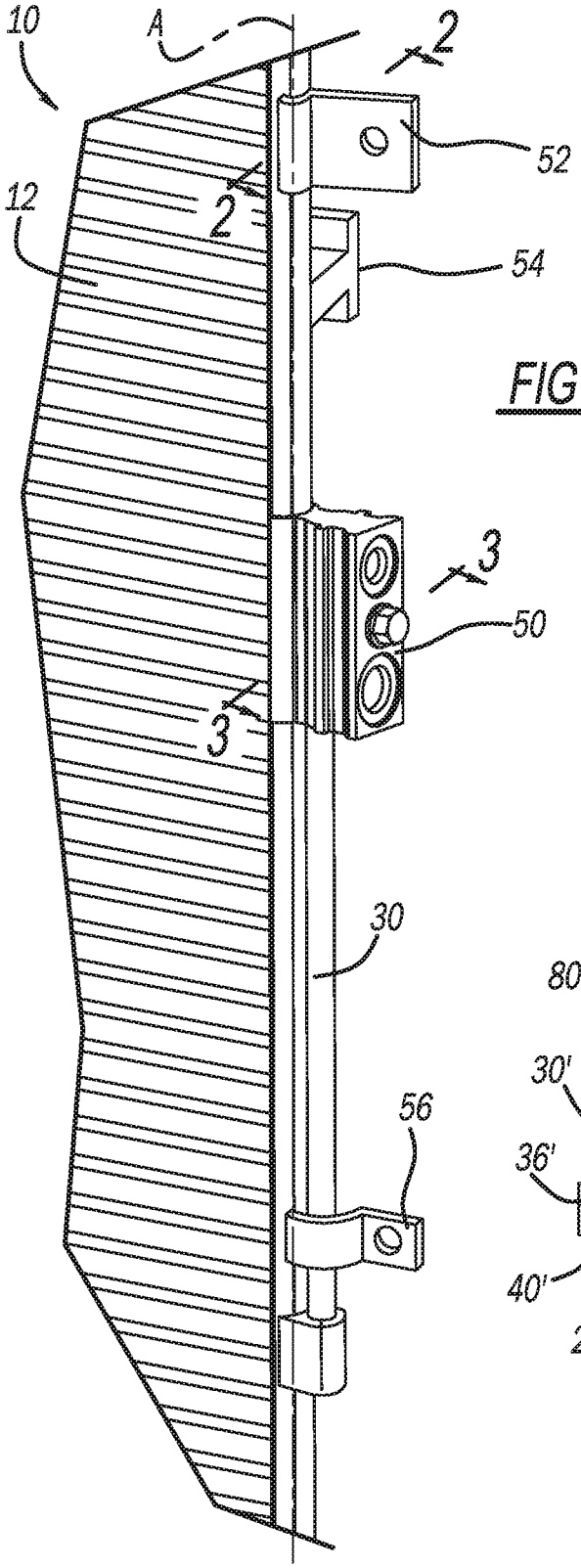
FIG. 1 illustrates one side of an exemplary heat exchanger in accordance with the present disclosure.

FIG. 1 illustrates a condenser 10. The condenser 10 can be any condenser for any suitable application, such as a vehicle heating, ventilation, and air conditioning (HVAC) system. Although the drawings illustrate the condenser 10, the present disclosure is applicable to any suitable heat exchanger, not just the condenser 10 illustrated. Other suitable heat exchangers include, but are not limited to, oil coolers and heat sinks.

The condenser 10 includes a core 12 through which refrigerant is circulated. Both ends of the core 12 include a header 20 (see FIGS. 2 and 3), which is connected to a tank 30, such as by brazing. Although the drawings only illustrate one end of the condenser 10, the opposite end also includes a header and a tank, which are the same as, or substantially similar to, the illustrated header 20 and tank 30. Mounted to the tank 30 (as well as the tank on the end of the core 12 opposite to the tank 30) are various connectors and coupling members, such as connector block 50, connector bracket 52, connector bracket 54, and connector bracket 56. The connectors 50-56 are mounted to the tank 30 by brazing.

Figure 2:
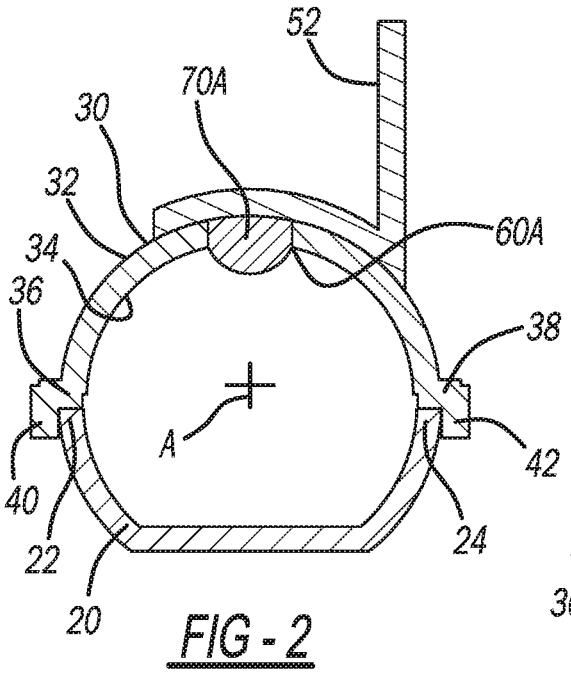
FIG. 2 is a cross-sectional view taken along line 2-2 of FIG. 1.
Figure 3:
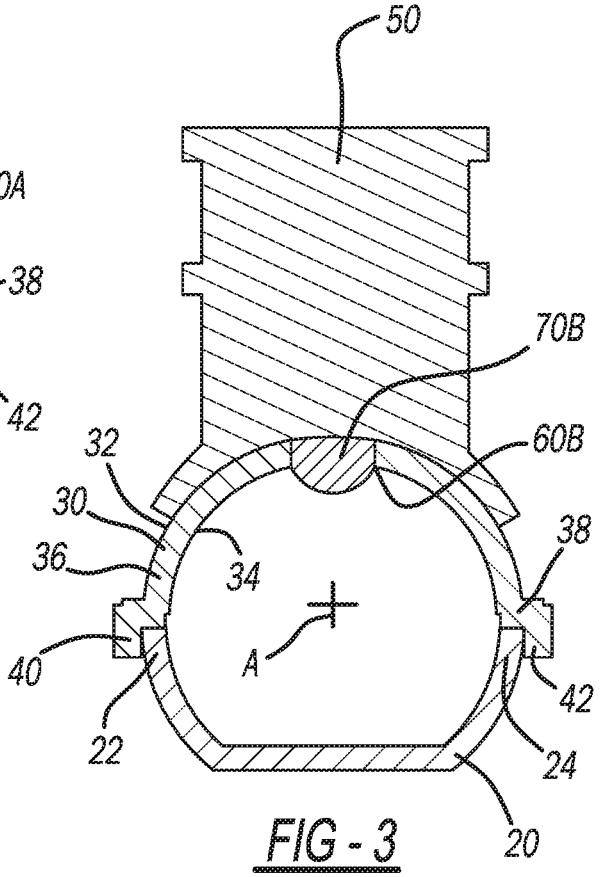
FIG. 3 is a cross-sectional view taken along line 3-3 of FIG. 1.

With particular reference to FIGS. 2 and 3, the header 20 includes a first header side 22 and a second header side 24. Each one of the first and second header sides 22 and 24 extend generally parallel to a longitudinal axis A of an assembly including the header 20 and tank 30 brazed together. The tank 30 includes an outer tank surface 32, which is opposite to an inner tank surface 34. A first tank side 36 and a second tank side 38 of the tank 30 each extend parallel to the longitudinal axis A. At the first tank side 36 is a first tank flange 40. At the second tank side 38 is a second tank flange 42. The header 20 is arranged such that: the first header side 22 is inside and abuts the first tank flange 40; and the second header side 24 is inside of, and abuts, the second tank flange 42. The header 20 and the tank 30 are brazed together at the interface between the first header side 22 and the first tank flange 40, as well as at the interface between the second header side 24 and the second tank flange 42.

Each one of the connectors 50, 52, 54, and 56 is spot welded to the tank 30 in order to hold the connectors 50, 52, 54, and 56 in place so that the connectors 50, 52, 54, and 56 can be brazed to the tank 30. With reference to FIG. 2, the tank 30 defines a welding aperture 60A. The welding aperture 60A is formed in any suitable manner, such as by stamping. The welding aperture 60A is equidistant between the first tank side 36 and the second tank side 38. Thus the welding aperture 60A is also equidistant between the interface between the header 20 and the tank 30.

To secure the connector 52 against the tank 30 in preparation for brazing, a weld 70A is applied within the welding aperture 60A from the inner tank surface 34. The weld 70A can fill the entire welding aperture 60A. Each one of the connectors 54 and 56 is also welded to the tank 30 through welding apertures similar to the welding apertures 60A, so as to hold the connectors 54 and 56 against the tank 30 prior to being brazed to the tank 30.

Figure 4:
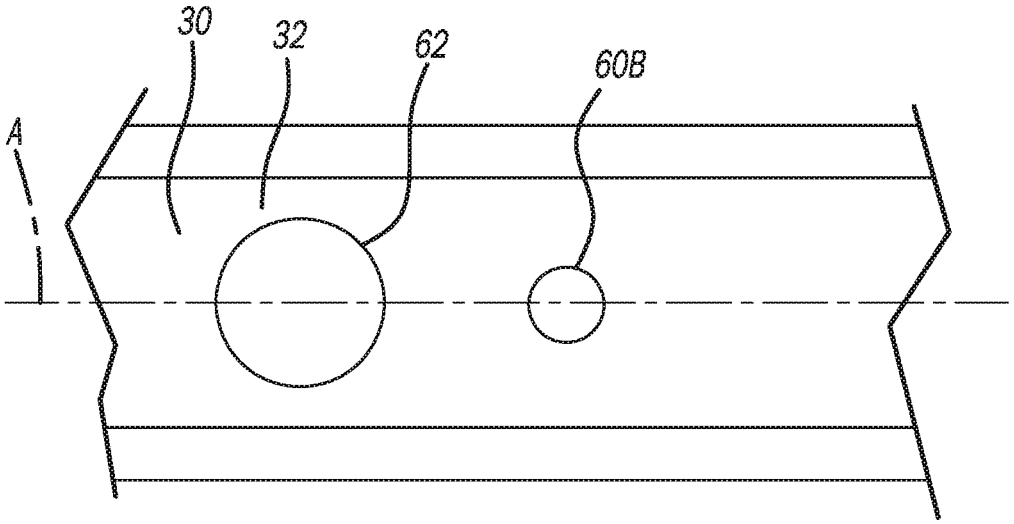
FIG. 4 is a plan view of a portion of the tank of FIG. 1 to which a connector block is mounted.

FIG. 3 illustrates another welding aperture 60B defined by the tank 30 at the area of the tank 30 where the connector block 50 is brazed to the tank 30. To hold the connector block 50 against the tank 30 in preparation for brazing, a weld 70B is formed between the tank 30 and the connector block 50 within the welding aperture 60B from a side of the welding aperture 60B at the inner tank surface 34. The weld 70B can completely fill the welding aperture 60A. As illustrated in FIG. 4, the welding aperture 60B is spaced apart from fluid aperture 62 defined by the tank 30. The connector block 50 is seated over the fluid aperture 62 to allow refrigerant flowing through the connector block 50 to enter the core 12.

Figure 5:
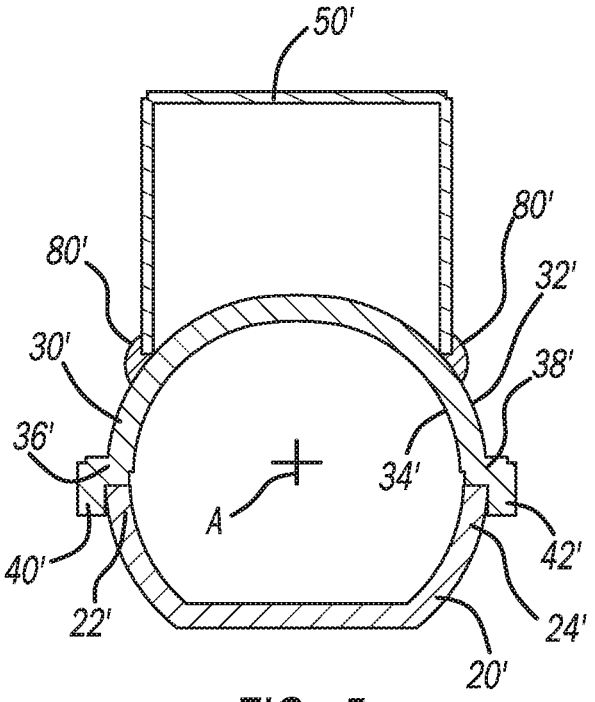
FIG - 5 Prior Art
FIG. 5 is a cross-sectional view of a header and tank of a prior art heat exchanger with a connector block welded to the tank.

The present disclosure provides numerous advantages over the art. For example, by including welding apertures 60A and 60B, which are equidistant between the brazing interfaces between the header 20 and the tank 30, heat generated by the welds at the welding apertures 60A and 60B will not damage the interface between the header 20 and the tank 30 at the first and second tank sides 36 and 38 and first and second header sides 22 and 24. In contrast to the present disclosure, and as illustrated in prior art FIG. 5, prior heat exchangers would secure the connectors, such as connector block 50', to the outer tank surface 32' with spot welds arranged about an outer periphery of connector block 50'. These prior art spot welds are illustrated in FIG. 5 at reference numerals 80'.

The prior art welds 80' are too close to the interfaces between the header 20' and the tank 30'. Thus heat from the prior art welds could sometimes deform or damage the first tank side 36', the first tank flange 40', the second tank side 38', the second tank flange 42', the first header side 22', and the second header side 24'. As a result, the header 20' and the tank 30' would sometimes not fit securely and closely together, thus resulting in incomplete brazing therebetween, which could result in leaks and other problems. The present teachings avoid the issues of the prior art by securing the connectors 50-56 by welding through welding apertures beneath the connectors 50-56 (such as welding apertures 60A and 60B, for example) arranged equidistant from the first tank side 36 and the second tank side 38 where brazing occurs.

The present disclosure further includes a method of assembling a heat exchanger, such as the condenser 10. The method includes forming the welding apertures 60A and 60B (as well as similar welding apertures where any other connectors are to be mounted) at the outer tank surface 32 in any suitable manner, such as by stamping. In preparation for brazing, the connectors 50-56 are secured to the tank 30 by welds (such as welds 70A and 70B, for example) formed within the welding apertures 60A and 60B. The welds 70A and 70B can fill an entirety of the welding apertures 60A and 60B. After the connectors 50 and 52 are secured in place by welding, and any other connectors (such as connectors 54 and 56) are welded in a similar manner, the connectors 50-56 are brazed onto the outer tank surface 32. Also, the header 20 and tank 30 are brazed together at the first tank side 36 and the first header side 22, as well as at the second tank side 38 and the second header side 24. One skilled in the art will appreciate that the present disclosure provides numerous additional advantages and unexpected results over the prior art.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A heat exchanger comprising:

a core;

a header on a side of the core, the header including a first header side and a second header side;

a tank brazed to the header, the tank including a first tank side and a second tank side, the header and the tank are brazed together at a first interface between the first header side and the first tank side and at a second interface between the second header side and the second tank side;

a connector brazed to an outer surface of the tank;

a welding aperture defined by the tank beneath the connector, a weld at the welding aperture secures the connector to the tank prior to brazing of the connector and the tank together, the weld entirely fills the welding aperture, the welding aperture is equidistant between the first tank side and the second tank side; and a fluid aperture defined by the tank beneath the connector, the fluid aperture is spaced apart from the welding aperture.

2. The heat exchanger of claim 1, wherein the heat exchanger is a condenser.

3. The heat exchanger of claim 1, wherein the heat exchanger is one of an oil cooler and heat sink.

4. The heat exchanger of claim 1, wherein the connector is a connector block.

5. The heat exchanger of claim 1, wherein the connector is a connector bracket.

6. The heat exchanger of claim 1, wherein the welding aperture is stamped in the tank.

7. The heat exchanger of claim 1, wherein the weld is from an inner surface of the tank, which is opposite to the outer surface of the tank to which the connector is brazed to.

8. The heat exchanger of claim 1, wherein the fluid aperture is equidistant between the first tank side and the second tank side.

9. A heat exchanger comprising:

a core;

a header on a side of the core, the header including a first header side that extends parallel to a longitudinal axis of the header, and a second header side that extends parallel to the longitudinal axis of the header;

a tank including a first tank side that extends parallel to a longitudinal axis of the tank, and a second tank side that extends parallel to the longitudinal axis of the tank, wherein the first tank side is brazed to the first header side and the second tank side is brazed to the second header side;

a welding aperture defined by the tank equidistant between the first tank side and the second tank side;

a fluid aperture defined by the tank beneath the connector, the fluid aperture is spaced apart from the welding aperture; and a connector brazed to an outer surface of the tank over the welding aperture, a weld at the welding aperture retains the connector against the outer surface prior to brazing, the weld is applied from an inner surface of the tank, which is opposite to the outer surface of the tank, the weld entirely fills the welding aperture.

10. The heat exchanger of claim 9, wherein the heat exchanger is one of a condenser, oil cooler, or heat sink.

11. The heat exchanger of claim 9, wherein:

the tank includes a first tank flange at the first tank side and a second tank flange at the second tank side; and the first header side is brazed to the first tank flange, and the second header side is brazed to the second tank flange.

12. The heat exchanger of claim 9, wherein the fluid aperture is equidistant between the first tank side and the second tank side.

* * * * *